United States Patent [19]

Goerlich et al.

[11] Patent Number: 4,744,217

[45] Date of Patent: May 17, 1988

[54] PARTICLE SEPARATOR ARRANGEMENT IN AN EXHAUST PIPE OF A DIESEL ENGINE

[75] Inventors: Dieter Goerlich, Emmering; Wilfried Meiler, Weilheim; Dieter Ráethel, Mittelstetten, all of Fed. Rep. of Germany

[73] Assignee: Webasto-Werk W. Baier GmbH & Co., Stockdorf, Fed. Rep. of Germany

[21] Appl. No.: 21,687

[22] Filed: Mar. 4, 1987

[30] Foreign Application Priority Data

Mar. 12, 1986 [DE] Fed. Rep. of Germany ..... 3608179

[51] Int. Cl.[4] ..... F01N 3/02

[52] U.S. Cl. ..... 60/303; 55/466; 55/DIG. 30

[58] Field of Search ..... 60/286, 303; 55/466, 55/DIG. 30

[56] References Cited

U.S. PATENT DOCUMENTS 4,345,431 8/1982 Suzuki ..... 60/303
4,622,810 11/1986 Shinsei ..... 60/303

FOREIGN PATENT DOCUMENTS 3204176 8/1983 Fed. Rep. of Germany .
136511 8/1984 Japan ..... 60/286
221415 12/1984 Japan ..... 60/286

*Primary Examiner*—Douglas Hart

*Attorney, Agent, or Firm*—Sixbey, Friedman & Leedom

[57] ABSTRACT

In an exhaust gas pipe of a diesel engine, a particle separator serving for reduction of the particle emission of the diesel engine by exhaust gas aftertreatment, a burner by which the particle separator can be regenerated by means of hot fuel gases delivered by the burner unit, the burner unit is so placed that, even in the case of leaks occurring at a flap valve for shutting off of the fuel gas line, no impairment of the operation of the burner is to be feared. For this purpose, upstream from the burner, a blower may be installed, which constantly provides air to the burner unit and the space of the fuel gas line between the flap valve and the burner unit, the air being discharged from the space into the environment by a vent pipe. In this way, exhaust gases, which leak past the closed flap valve into the fuel gas line, do not reach the burner and are discharged by the vent pipe into the enviroment. Alternatively, a suction blower can be placed in a vent pipe branching off from the space between the flap valve and the burner unit in the fuel gas line, this blower causing venting of the space, when the separator is not being regenerated and the flap valve is closed. According to another alternative embodiment, a bypass pipe goes from the space between the flap valve and the burner unit, into a section of the exhaust gas pipe located downstream from the separator. The discharge area of this bypass pipe is designed as an injector or ejector, so that a negative pressure is produced in the bypass pipe by which the space in the fuel gas line is vented.

14 Claims, 1 Drawing Sheet

PARTICLE SEPARATOR ARRANGEMENT IN AN EXHAUST PIPE OF A DIESEL ENGINE

BACKGROUND AND SUMMARY OF THE INVENTION

The invention relates to a particle separator in an exhaust pipe of a diesel engine.

The term "fuel gases" as used herein after means in general hot gases having such a temperature that the burning of the particles separated in the separator is initiated in order to remove the particles for regenerating the filter means. These hot gases can be produced for instance by a combustion process using a burner unit or in any other way or even the exhaust gases of the engine can be directly used provided that the temperature thereof is appropriate for initiating the burning of the particles, such as carbon black particles in the exhaust gases of a diesel engine.

From German Offenlegungsschrift No. 32 04 176 a device is known for reduction of the particle emission of diesel engines by exhaust gas aftertreatment with a device having a particle separator-filter in an exhaust gas pipe of a diesel engine. Before the particle separator-filter inlet, a fuel gas line comes out into the exhaust gas pipe, by which fuel gases (gases that are the product of a burner combustion process for example), delivered by a burner, is fed to the particle separator-filter to regenerate it. With the help of a flap valve the exhaust gas in the exhaust gas pipe is deflected to a second particle separator-filter, when the first particle separator-filter is being regenerated and this flap valve then produces a flow connection with the fuel gas line and the intake side of the filter to be regenerated.

During normal operation of the particle separator-filter, when the flap valve shuts off the fuel gas line, it is observed, again and again, that exhaust gas leaks past the flap valve from the exhaust gas pipe and enters into the fuel gas line. It has been shown that a tight closing of such a flap valve, in the long run, cannot be brought about in an economically justifiable way. If exhaust gases from the exhaust gas pipe enter into the fuel gas line and get to the burner, as a result, the burner can be thermally overloaded and clogged so that reliable ignition and operation of the burner can no longer by guaranteed.

Accordingly, the present invention has a primary object of developing a particle separator within an exhaust gas pipe of a diesel engine which will, even with leaks present at the flap valve, shut off the fuel gas line, when the separator is not being regenerated, and no disadvantageous effect on the mode of operation of the burner is to be feared, if the burner is to be put into operation for regeneration of the separator.

According to preferred embodiments of the invention, a particle separator in an exhaust gas pipe of a diesel engine is provided which can be regenerated by means of fuel gases fed from a burner by a fuel gas line, in which a flap valve is placed between the intake side of the separator and the fuel gas line, which is opened for regeneration of the filter, and which significantly provides that the space in the fuel gas line between the flap valve and the burner is necessarily vented when the flap valve is closed.

With the design according to the invention, a particle separator in the exhaust gas pipe of a diesel engine is attained that, with the flap valve closed, exhaust gases going into the fuel gas line from the exhaust gas pipe are kept away from the burner. Especially if the flap valve does not tightly shut off the fuel gas line, these exhaust gases of the diesel engine are discharged before they reach the burner, thanks to the design according to the invention. Thus, the danger of a thermal overlaod of the burner and a clogging of it is effectively excluded.

According to a first preferred embodiment of the invention, a blower is installed upstream from the burner in the fuel gas line between the flap valve and the burner for venting of this space, a blower that constantly supplies air through the burner and through the space to be vented, when the flap valve in the fuel gas line is closed. The air supplied by the blower is then discharged into the environment by a vent pipe, which branches off from the first gas line before the flap valve. This blower may be an additional or auxiliary blower relative to the combustion air blower of the burner. The blower can suitably operate constantly, but at a reduced speed.

According to an alternate embodiment of the invention, a vent pipe branches off from the space of the fuel gas line to be vented, a vent pipe that contains a suction blower. The suction blower thus sucks gases from the space to be vented and delivers the withdrawn gases into the environment at its discharge side. To prevent functional impairments of the burner in its operating condition, when it is supposed to deliver fuel gases to the separator for regeneration, this venting pipe, or at least the blower, is preferably shut off during combustion operation of the burner.

Another alternate embodiment of the invention provides a bypass pipe, which goes from the space to be vented in the fuel gas line to a point in the exhaust gas pipe located downstream from the separator. In this connection, a negative pressure is produced in the bypass pipe, with the flap valve in the fuel gas line closed, a pressure that also prevails in the space to be vented, so that gases that have possibly come into this space are fed back into the exhaust gas pipe of the diesel engine by the bypass pipe and, thus, cannot get to the burner in the fuel gas line. To achieve this in the most constructive way possible, the portion of the bypass pipe that discharges into the exhaust gas pipe of the diesel engine downstream from the separator is so designed that this discharge portion operates as an injector or ejector which, on the basis of the flow conditions present in the exhaust gas pipe, independently produces a negative pressure in the bypass pipe.

These and further objects, features and advantages of the present invention will become more obvious from the following description when taken in connection with the accompanying drawings which show, for purposes of illustration only several embodiments in accordance with the present invention.

DETAILED DESCRIPTION OF THE PREFERRED EMBODIMENTS

Figure 1:
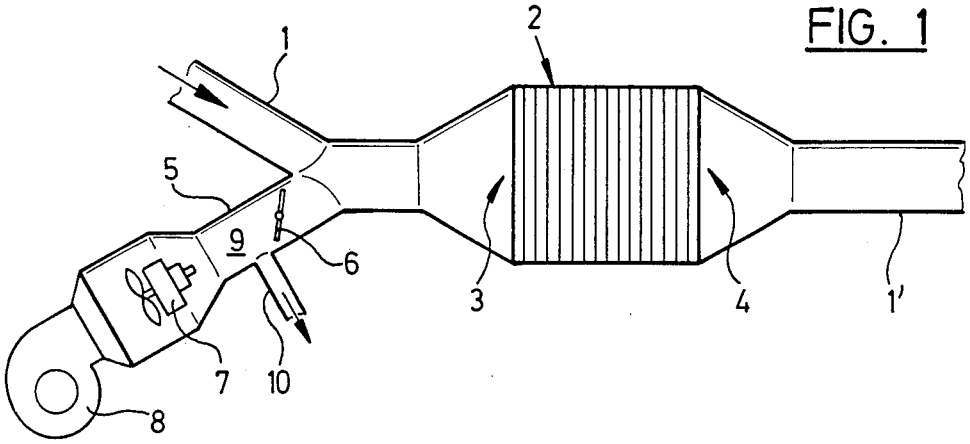
FIG. 1 is a diagrammatic view of a first embodiment of a particle separator in an exhaust gas pipe of a diesel engine in accordance with the present invention.

According to FIG. 1, a particle separator, identified overall by 2, for reduction of particle emissions of diesel engines by exhaust gas aftertreatment, is provided in an exhaust gas pipe 1 coming from a diesel engine (not shown). Separator 2 has an intake side 3 and an exhaust side 4, to which another section 1' of the exhaust gas pipe of the exhaust gas section of the diesel engine is connected. In the area of intake side 3 of separator 2, a fuel gas line 5 enters into exhaust gas pipe 1, a flap valve 6 being provided in a discharge area of fuel gas line 5. Flap valve 6 provides means by which fuel gas line 5 can be shut off when separator 2 is not being regenerated. Fuel gas line 5 contains a diagrammatically represented burner unit 7, which can be of conventional liquid or gas fuel operated design having an integrated blower 7' and which delivers hot gases in its operating condition. When burner unit 7 is operating, flap valve 6 is opened so that the hot gases from the burner are fed to the separator for regeneration thereof. The separator, itself, may be of any known design.

Since it causes difficulties to design flap valve 6 so that it completely seals fuel gas line 5, exhaust gases can leak by the flap valve into line 5 from exhaust gas pipe 1, even with flap valve 6 closed. If exhaust gases enter into fuel gas line 5 and reach burner unit 7, there can result a danger of heat overloading of burner unit 7 as well as clogging of it, which, in turn, can result in the operational reliability of the burner unit being impaired.

As can further be seen in FIG. 1, a blower 8, in the form of an auxiliary blower (i.e., one in addition to an independent of blower 7' of blower unit 7), is installed upstream from burner unit 7. Blower 8 sucks the air from the environment and delivers the air constantly to the burner unit and into the space between the burner unit and the flap valve 6 of fuel gas line 5. Thus, with the burner unit inoperative and with flap valve 6 closed, the blower 8 bathes the burner unit 7 with air to prevent clogging and heat overloads. Additionally, between the burner unit 7 and flap valve 6 is a vent pipe 10, which branches off from fuel gas line 5. The air delivered by blower 8 and any exhaust gas that has penetrated into space 9 from the exhaust gas pipe 1 are discharged into the environment after being vented from space 9. Blower 8 may operate continuously, not only during such times that valve 6 is closed; in which case, it is preferred that the blower speed be reduced when valve 6 is opened.

Figure 2:
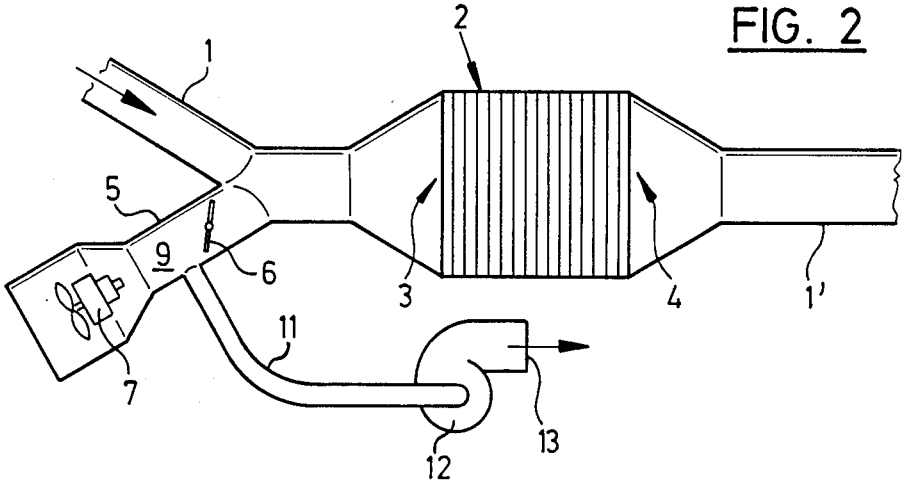
FIG. 2 is a diagrammatic view, similar to FIG. 1, of a modified embodiment of the invention.

In the embodiment according to FIG. 2, identical or similar parts are provided with the same reference numbers as in FIG. 1. This embodiment differs from that of FIG. 1 in that a vent pipe 11 branches off from space 9 to be vented at a point between burner unit 7 and flap valve 6 of fuel gas line 5, and to which is connected a suction blower 12. Blower 12 sucks gases from space 9 and delivers the gases into the environment at its exhaust side 13.

Similar to FIG. 1, in the embodiment according to FIG. 2, blower 12 vents exhaust gases, which have entered into fuel gas line 5 by leaking past a closed valve 6, and discharges them into the environment to, in this way, avoid impairment of burner unit 7. Of course, this suction blower 12 is cut off if burner unit 7 is put into operation and flap valve 6 is opened to feed hot fuel gases to separator 2 for its regeneration.

Figure 3:
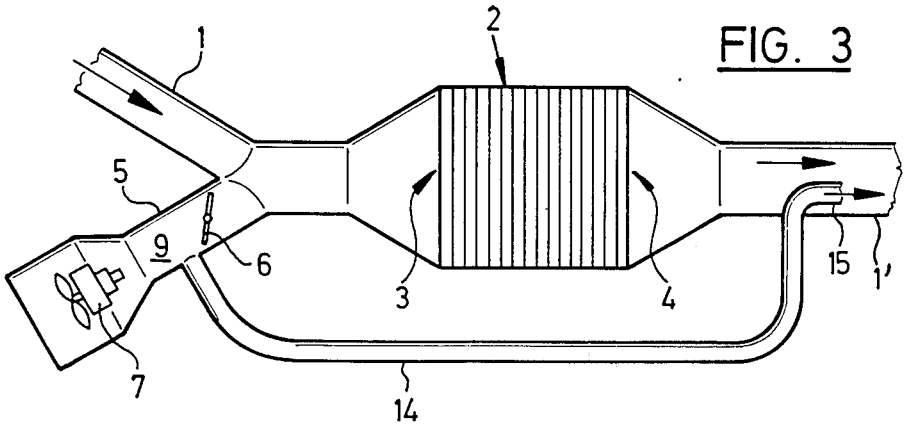
FIG. 3 is a diagrammatic view of another embodiment in accordance with the present invention.

Also, in the embodiment according to FIG. 3, identical or similar parts are provided with the same reference numbers as in FIG. 1. In contrast with the previous embodiments, in the embodiment according to FIG. 3, a bypass pipe 14 branches off from space 9 between flap valve 6 and burner unit 7, the other end 15 of which discharges into the section 1' of exhaust gas pipe 1 that is located downstream from separator 2. The discharge end 15 of bypass vent pipe 14 is so constituted and designed that it acts as an injector or ejector, so that a negative pressure is produced in bypass vent pipe 14, which also occurs in space 9, so that this space 9 is vented, by means of negative pressure, by bypass vent pipe 14 and the gases drawn from the space are again fed back into part 1' of exhaust gas pipe 1.

Although in the figures of the drawing it is not represented in detail, suitable open-loop and closed-loop control devices can, of course, be provided, which so control flap valve 6 in fuel gas line 5 in conjunction with the operation of burner unit 7 and the regeneration of separator 2 so that, during the operation of burner unit 7, the devices serving for venting of space 9 cause no impairment to the burner operation. In this regard, while not necessary, in certain cases it may be beneficial if the vent pipe is shut off when the burner is operating for regeneration of the separator, such as by another flap valve or any other means. The necessary venting of space 9 according to the invention makes it possible for lower sealing requirements to be made on the sealing of flap valve 6, and, thus, no very close tolerances or special seat configurations of a valve seat for the flap valve are necessary.

While we have shown and described various embodiments in accordance with the present invention, it is understood that the same is not limited thereto, but is susceptible of numerous changes and modifications as known to those skilled in the art, and we, therefore, do not wish to be limited of the details shown and described herein, but intend to cover all such changes and modifications as are encompassed by the scope of the appended claims.

What is claimed is:

1. An exhaust gas particle separation arrangement comprising a separator in an exhaust pipe and with a burner unit for regenerating the separator by means of fuel gases fed from the burner unit via a fuel gas line in which a flap valve is placed between an intake side of the separator and the burner unit, said valve being opened for regeneration of the separator and closed for closing off the fuel gas line when said burner unit is inoperative, wherein venting means is provided in communication with the fuel gas line, at a location between the flap valve and the burner unit, for withdrawing exhaust gases leaking past the flap valve into the fuel gas line away from the burner unit when said fuel gas line is closed off by said flap valve.

2. A particle separation arrangement according to claim 1, wherein said venting means comprises a blower for delivering a flow of air past the burner unit, and a vent pipe leading to the environment that branches off from fuel gas line between the burner unit and the flap valve.

3. A particle separation arrangement according to claim 2, wherein the venting means causes the blower to operate continuously when said valve is closed.

4. A particle separation arrangement according to claim 3, wherein said venting means causes the blower to operate continuously when said valve is open, but at a reduced speed relative to its speed when said flap valve is closed.

5. A particle separation arrangement according to claim 1, wherein said venting means comprises a vent pipe branching off from said space in the fuel gas line to be vented, said vent pipe containing a suction blower, an exhaust side of said blower being connected to the environment.

6. A particle separation arrangement according to claim 2, wherein said venting means is inoperative during operation of said burner unit for regeneration of said separator.

7. A particle separation arrangement according to claim 1, wherein a bypass vent pipe branches off from said space in fuel gas line to be vented, said bypass vent pipe being connected, at a discharge end, to said exhaust pipe at a location downstream from said separator.

8. A particle separation arrangement according to claim 7, wherein the discharge end of the bypass vent pipe is constructed in a manner that, when the flap valve is closed, a negative pressure constantly prevails in said space to be vented, the bypass venting pipe thereby serving as a vacuum evacuating means for withdrawing gases from said space and discharging them into the exhaust pipe at said downstream location.

9. An exhaust gas particle separation arrangement comprising a separator in an exhaust pipe and with a burner unit for regenerating the separator by means of fuel gases fed from the burner unit via a fuel gas line in which a flap valve is placed between an intake side of the separator and the burner unit, said valve being opened for regeneration of the separator, wherein venting means is provided for venting a space in the fuel gas line between the flap valve and the burner unit when the flap valve is closed, and wherein said venting means comprises a blower for delivering a flow of air past the burner unit, and a vent pipe leading to the environment that branches off from fuel gas line between the burner unit and the flap valve.

10. A particle separation arrangement according to claim 9, wherein the venting means causes the blower to operate continuously when said valve is closed.

11. A particle separation arrangement according to claim 10, wherein said venting means causes the blower to operate continuously when said valve is open, but at a reduced speed relative to its speed when said flap valve is closed.

12. A particle separation arrangement according to claim 9, wherein said venting means is inoperative during operation of said burner unit for regeneration of said separator.

13. An exhaust gas particle separation arrangement comprising a separator in an exhaust pipe and with a burner unit for regenerating the separator by means of fuel gases fed from the burner unit via a fuel gas line in which a flap valve is placed between an intake side of the separator and the burner unit, said valve being opened for regeneration of the separator, wherein venting means is provided for venting a space in the fuel gas line between the flap valve and the burner unit when the flap valve is closed, and wherein said venting means comprises a vent pipe branching off from said space in the fuel gas line to be vented, said vent pipe containing a suction blower, an exhaust side of said blower being connected to the environment.

14. An exhaust gas particle separation arrangement comprising a separator in an exhaust pipe and with a burner unit for regenerating the separator by means of fuel gases fed from the burner unit via a fuel gas line in which a flap valve is placed between an intake side of the separator and the burner unit, said valve being opened for regeneration of the separator, wherein venting means is provided for venting a space in the fuel gas line between the flap valve and the burner unit when the flap valve is closed, and wherein a bypass vent pipe branches off from said space in fuel gas line to be vented, said bypass vent pipe being connected, at a discharge end, to said exhaust pipe at a location downstream from said separator, and wherein the discharge end of the bypass vent pipe is constructed in a manner that, when the flap valve is closed, a negative pressure constantly prevails in said space to be vented, the bypass venting pipe thereby serving as a vacuum evacuating means for withdrawing gases from said space and discharging them into the exhaust pipe at said downstream location.

* * * * *